US011834835B2

(12) United States Patent
Svec et al.

(10) Patent No.: US 11,834,835 B2
(45) Date of Patent: Dec. 5, 2023

(54) INTERLOCKING LAMINATED STRUCTURAL ROOFING PANELS

(71) Applicant: Building Materials Investment Corporation, Dallas, TX (US)

(72) Inventors: James A. Svec, Kearny, NJ (US); Daniel E. Boss, Morris Township, NJ (US)

(73) Assignee: BMIC LLC, Dallas, TX (US)

( * ) Notice: Subject to any disclaimer, the term of this patent is extended or adjusted under 35 U.S.C. 154(b) by 102 days.

(21) Appl. No.: 17/215,011

(22) Filed: Mar. 29, 2021

(65) Prior Publication Data

US 2021/0301534 A1 Sep. 30, 2021

Related U.S. Application Data

(60) Provisional application No. 63/061,832, filed on Aug. 6, 2020, provisional application No. 63/010,913, filed (Continued)

(51) Int. Cl.
*E04D 3/35* (2006.01)
*E04D 3/36* (2006.01)

(52) U.S. Cl.
CPC ..... *E04D 3/351* (2013.01); *E04D 3/3601* (2013.01)

(58) Field of Classification Search
CPC ..... E04D 3/3601; E04D 3/36; E04D 3/365; E04D 3/38; E04D 3/40; E04D 3/35;

(Continued)

(56) References Cited

U.S. PATENT DOCUMENTS 220,181 A 9/1879 Slaughter
550,325 A 11/1895 Kinnear (Continued)

FOREIGN PATENT DOCUMENTS

CA 2526602 C 10/2013
EP 2597398 A2 5/2013

(Continued)

OTHER PUBLICATIONS amazon.com; USP Structural Connectors #TPP36 3×6 Pronged Truss Plate; https://www.amazon.com/USP-STRUCTURAL-CONNECTORS-TPP36-Pronged/dp/B0044ULCA4; available as of Aug. 18, 2016 / retrieved by the searching authority from the internet on Jun. 8, 2021.

(Continued)

*Primary Examiner* — Jessica L Laux
(74) *Attorney, Agent, or Firm* — WOMBLE BOND DICKINSON (US) LLP

(57) ABSTRACT

Interlocking laminated structural roofing panels have a light-weight foamed core sandwiched between outer and inner layers of materials such as wood, polymer materials, fire resistant and/or waterproof membranes, and metal layers. At least one layer is a self-gripping metal sheet that grips and bonds mechanically to adjacent layers such as wood layers. A self-gripping metal sheet may be used on both sides of the roofing panels to form a panel that is strong, structurally robust, and able to span between relatively widely spaced roof rafters with little or no mid-span support. Interlocking features along the edges of the panels interlock adjacent panels together to form a strong monolithic roof covering for a roof.

20 Claims, 10 Drawing Sheets

Related U.S. Application Data on Apr. 16, 2020, provisional application No. 63/001,561, filed on Mar. 30, 2020.

(58) Field of Classification Search
CPC ..... E04D 3/351; E04D 3/352; E04D 3/354; E04D 3/355; E04D 3/358
See application file for complete search history.

(56) References Cited

U.S. PATENT DOCUMENTS 1,329,794 A 2/1920 Moomaw
1,539,632 A 5/1925 Belding
1,743,206 A 1/1930 Fulenwider et al.
2,042,890 A 6/1936 Fulenwider et al.
2,766,861 A 10/1956 Abramson
2,872,882 A * 2/1959 Paul ..... E04D 3/354 52/393
3,111,787 A * 11/1963 Chamberlain ..... E04D 3/352 156/247
3,325,952 A 6/1967 Trachtenberg
3,347,001 A 10/1967 Cosden
3,363,380 A 1/1968 Merrill
3,412,517 A 11/1968 Ellis et al.
3,468,086 A 9/1969 Warner
3,848,383 A 11/1974 Wilson et al.
3,899,855 A 8/1975 Gadsby
4,079,561 A 3/1978 Vallee
4,111,188 A 9/1978 Murphy, Jr.
4,135,342 A 6/1979 Cotter
4,157,638 A * 6/1979 Della-Donna ..... E04C 2/243 D25/138
4,163,351 A 8/1979 Ishikawa
4,189,889 A 2/1980 Yanoh
4,336,413 A 6/1982 Tourneux
4,343,126 A 8/1982 Hoofe, III
4,357,377 A * 11/1982 Yamamoto ..... E04D 11/02 428/920
4,392,009 A 7/1983 Napoli
4,445,305 A 5/1984 Orie, Sr.
4,453,349 A 6/1984 Ryan
4,469,731 A * 9/1984 Saracino ..... E04F 13/0864 428/137
4,499,645 A * 2/1985 Luomanen ..... E04D 3/352 52/528
4,499,700 A 2/1985 Gustafsson
4,522,007 A 6/1985 Oehlert
4,580,383 A 4/1986 Pittsman et al.
4,582,953 A 4/1986 Nagase et al.
4,587,164 A * 5/1986 Freeman ..... E04B 7/22 428/319.1
4,592,183 A 6/1986 See
4,683,697 A 8/1987 Gregg
4,856,236 A 8/1989 Parker
4,932,184 A 6/1990 Waller
4,936,063 A 6/1990 Humphrey
5,056,288 A 10/1991 Funaki
5,074,093 A 12/1991 Meadows
5,295,338 A 3/1994 Guffey et al.
5,338,369 A 8/1994 Rawlings
5,345,740 A 9/1994 Huang
5,349,801 A 9/1994 Verbofsky
5,373,674 A * 12/1994 Winter, IV ..... E04C 2/288 52/309.9
5,409,549 A 4/1995 Mori
5,465,543 A 11/1995 Seifert
5,469,680 A 11/1995 Hunt
5,535,567 A 7/1996 Cahoon
5,598,677 A 2/1997 Rehm, III
5,613,337 A 3/1997 Plath et al.
5,636,481 A 6/1997 De Zen
5,642,596 A 7/1997 Waddington
5,651,837 A 7/1997 Ohtsuka et al.
5,746,839 A 5/1998 Dinwoodie
5,752,355 A 5/1998 Sahramaa
5,768,844 A 6/1998 Grace, Sr. et al.
5,881,501 A 3/1999 Guffey et al.
5,951,785 A 9/1999 Uchihashi et al.
6,065,256 A 5/2000 Joko et al.
6,105,314 A 8/2000 Stocksieker
6,111,189 A 8/2000 Garvison et al.
6,170,215 B1 1/2001 Nasi
6,272,807 B1 8/2001 Waldrop
6,282,858 B1 9/2001 Swick
6,314,704 B1 11/2001 Bryant
6,370,828 B1 4/2002 Genschorek
6,465,724 B1 10/2002 Garvison et al.
6,521,821 B2 2/2003 Makita
6,581,348 B2 6/2003 Hunter, Jr.
RE38,210 E 8/2003 Plath et al.
6,606,823 B1 8/2003 McDonough et al.
6,647,687 B2 11/2003 Kern
6,772,569 B2 8/2004 Bennett et al.
6,907,701 B2 6/2005 Smith
6,912,822 B2 7/2005 Vos
6,914,182 B2 7/2005 Takeda et al.
7,178,295 B2 2/2007 Dinwoodie
7,246,474 B2 7/2007 Dombek et al.
7,328,534 B2 2/2008 Dinwoodie
7,342,171 B2 3/2008 Khouri et al.
7,413,790 B2 8/2008 Hutter, III
7,487,771 B1 2/2009 Eiffert et al.
7,513,084 B2 4/2009 Arguelles
7,607,271 B2 10/2009 Griffin et al.
7,690,169 B2 4/2010 Saarenko et al.
7,712,278 B2 5/2010 Lonardi
7,721,506 B2 5/2010 Bennett et al.
7,739,848 B2 6/2010 Trout
7,748,191 B2 7/2010 Podirsky
7,811,663 B2 10/2010 Paradis et al.
7,900,407 B2 3/2011 Plaisted
7,900,414 B2 3/2011 Seccombe
8,028,474 B2 10/2011 Beck et al.
8,028,475 B2 10/2011 Sigmund et al.
8,074,417 B2 12/2011 Trabue et al.
8,104,239 B2 1/2012 Fath
8,171,689 B2 5/2012 Pierson et al.
8,215,071 B2 7/2012 Lenox
8,316,603 B2 * 11/2012 Flynn ..... B32B 3/28 52/309.3
8,316,609 B2 11/2012 Ben-Zvi
8,371,076 B2 2/2013 Jones et al.
8,382,513 B2 2/2013 Kobayashi
8,476,523 B2 7/2013 Bennett
8,495,839 B2 7/2013 Tsuzuki
8,511,006 B2 8/2013 Reisdorf et al.
8,590,270 B2 11/2013 Martinique
8,635,828 B2 1/2014 Bahnmiller
8,677,709 B2 3/2014 DiLonardo et al.
8,806,827 B2 8/2014 Perttula et al.
8,813,460 B2 8/2014 Cinnamon et al.
8,863,461 B2 10/2014 Wagner et al.
8,869,478 B2 10/2014 Gianolio
8,875,454 B2 11/2014 Arguelles
8,898,963 B1 12/2014 Amatruda et al.
8,991,129 B1 3/2015 Kramer
9,003,733 B1 4/2015 Simpson et al.
9,032,679 B2 5/2015 Propst
9,091,082 B2 7/2015 Wakebe
9,169,646 B2 10/2015 Rodrigues
9,181,704 B2 11/2015 Rasmussen et al.
9,206,606 B2 12/2015 Jaks
9,273,885 B2 3/2016 Rodrigues et al.
9,291,225 B2 3/2016 Arbesman et al.
D754,885 S 4/2016 Rasmussen et al.
9,334,652 B2 5/2016 Plath et al.
9,356,174 B2 5/2016 Duarte et al.
D764,687 S 8/2016 Anderson et al.
9,404,262 B1 8/2016 Smith, Jr.
9,435,125 B2 9/2016 Wakebe
9,523,202 B2 12/2016 Anderson et al.
9,574,351 B2 2/2017 Karr et al.
9,611,647 B2 4/2017 Yang
9,670,976 B2 6/2017 Arbesman et al.

(56) References Cited

U.S. PATENT DOCUMENTS

| | | | |
|---|---|---|---|
| 9,689,164 | B2 | 6/2017 | Rasmussen et al. |
| 9,708,814 | B2 | 7/2017 | Vander Laan et al. |
| 9,813,016 | B2 | 11/2017 | Chabas et al. |
| 9,876,132 | B2 | 1/2018 | Morad et al. |
| 9,890,537 | B2 | 2/2018 | Martin et al. |
| 9,919,835 | B2 | 3/2018 | Brisendine et al. |
| 9,970,197 | B2 | 5/2018 | Maurer et al. |
| 10,027,274 | B2 | 7/2018 | Van Giesen et al. |
| 10,115,859 | B2 | 10/2018 | Rodrigues et al. |
| 10,187,005 | B2 | 1/2019 | Rodrigues et al. |
| 10,196,807 | B2 | 2/2019 | Kwong |
| 10,196,821 | B2 | 2/2019 | Anderson et al. |
| 10,233,645 | B2 | 3/2019 | Izumi et al. |
| 10,256,765 | B2 | 4/2019 | Rodrigues et al. |
| 10,294,669 | B2 | 5/2019 | Prygon |
| 10,315,382 | B2 | 6/2019 | Arbesman |
| 10,316,519 | B2 | 6/2019 | Bogh et al. |
| 10,316,911 | B2 | 6/2019 | Arbesman et al. |
| 10,335,847 | B2 | 7/2019 | Arbesman et al. |
| 10,415,245 | B2 | 9/2019 | Bennett et al. |
| 10,465,384 | B2 | 11/2019 | Bogh et al. |
| 10,505,492 | B2 | 12/2019 | Hudson et al. |
| 10,505,493 | B2 | 12/2019 | Karkheck |
| 10,547,270 | B2 | 1/2020 | Hudson et al. |
| 10,560,048 | B2 | 2/2020 | Fisher et al. |
| 10,590,652 | B2 | 3/2020 | Dye et al. |
| 10,596,612 | B2 | 3/2020 | Jordan |
| 10,612,231 | B2 | 4/2020 | Nieminen |
| 10,673,373 | B2 | 6/2020 | Hudson et al. |
| 10,693,413 | B2 | 6/2020 | Rodrigues |
| 10,749,460 | B2 | 8/2020 | Guo |
| 10,808,403 | B2 | 10/2020 | Bodwell et al. |
| 10,817,838 | B1 | 10/2020 | Jalla |
| 10,822,800 | B2 | 11/2020 | Kraft |
| 10,866,012 | B2 | 12/2020 | Kvasnicka et al. |
| 10,876,304 | B2 | 12/2020 | Shaw |
| 10,895,076 | B1 | 1/2021 | Folkersen et al. |
| 10,917,033 | B2 | 2/2021 | Rodrigues |
| 10,920,429 | B2 | 2/2021 | Shaw |
| 10,968,634 | B2 | 4/2021 | Bolo |
| 11,012,024 | B2 | 5/2021 | Rodrigues et al. |
| 11,025,192 | B2 | 6/2021 | Livsey et al. |
| 11,028,590 | B1 | 6/2021 | Boss et al. |
| 11,220,817 | B2 | 1/2022 | Hortom |
| 11,236,510 | B2 | 2/2022 | Stephan et al. |
| 11,248,377 | B1 | 2/2022 | Wang et al. |
| 11,261,603 | B2 | 3/2022 | Izumi et al. |
| 11,414,865 | B2 | 8/2022 | Sealock et al. |
| 11,447,954 | B2 | 9/2022 | McDonald |
| 2003/0010374 | A1 | 1/2003 | Dinwoodie |
| 2004/0000334 | A1 | 1/2004 | Ressler |
| 2004/0031518 | A1 | 2/2004 | Plantfeber |
| 2004/0187909 | A1 | 9/2004 | Sato et al. |
| 2004/0226247 | A1 | 11/2004 | Byrd |
| 2005/0076948 | A1 | 4/2005 | Komamine |
| 2005/0144850 | A1* | 7/2005 | Hageman ..... E04D 3/358 52/3 |
| 2005/0257453 | A1 | 11/2005 | Cinnamon |
| 2006/0225780 | A1 | 10/2006 | Johnson, III et al. |
| 2007/0137132 | A1 | 6/2007 | Plowright |
| 2007/0181174 | A1 | 8/2007 | Ressler |
| 2007/0199590 | A1 | 8/2007 | Tanaka et al. |
| 2007/0295393 | A1 | 12/2007 | Cinnamon |
| 2008/0155908 | A1 | 7/2008 | Nomura et al. |
| 2008/0190047 | A1 | 8/2008 | Allen |
| 2008/0302030 | A1 | 12/2008 | Stancel et al. |
| 2008/0302407 | A1 | 12/2008 | Kobayashi |
| 2008/0315061 | A1 | 12/2008 | Fath |
| 2009/0137168 | A1 | 5/2009 | Peng |
| 2010/0126561 | A1 | 5/2010 | Reich |
| 2010/0170169 | A1 | 7/2010 | Railkar et al. |
| 2010/0186334 | A1 | 7/2010 | Seem |
| 2010/0235206 | A1 | 9/2010 | Miller et al. |
| 2010/0236610 | A1 | 9/2010 | Stancel et al. |
| 2010/0294345 | A1 | 11/2010 | Leithold |
| 2010/0313499 | A1 | 12/2010 | Gangemi |
| 2010/0313501 | A1 | 12/2010 | Gangemi |
| 2011/0041446 | A1 | 2/2011 | Stephens et al. |
| 2011/0070765 | A1 | 3/2011 | Kobayashi |
| 2011/0232715 | A1 | 9/2011 | Lenox |
| 2011/0284058 | A1 | 11/2011 | Cinnamon |
| 2011/0302859 | A1 | 12/2011 | Crasnianski |
| 2012/0233940 | A1 | 9/2012 | Perkins et al. |
| 2012/0240490 | A1 | 9/2012 | Gangemi |
| 2012/0304559 | A1 | 12/2012 | Ishida |
| 2013/0014455 | A1 | 1/2013 | Grieco |
| 2013/0125482 | A1 | 5/2013 | Kalkanoglu et al. |
| 2013/0186028 | A1 | 7/2013 | Resso et al. |
| 2013/0318911 | A1 | 12/2013 | Sealock et al. |
| 2014/0102519 | A1 | 4/2014 | Rodrigues et al. |
| 2014/0166082 | A1 | 6/2014 | Langmaid et al. |
| 2014/0190096 | A1 | 7/2014 | Kacandes |
| 2014/0246078 | A1 | 9/2014 | Carolan et al. |
| 2014/0290744 | A1 | 10/2014 | Hood |
| 2014/0305050 | A1 | 10/2014 | Schulze et al. |
| 2015/0083197 | A1 | 3/2015 | Langmaid et al. |
| 2015/0275518 | A1 | 10/2015 | Flick |
| 2015/0354224 | A1 | 12/2015 | Maurer et al. |
| 2015/0372635 | A1 | 12/2015 | Praca et al. |
| 2016/0123013 | A1 | 5/2016 | Rasmussen et al. |
| 2017/0237387 | A1 | 8/2017 | Hudson et al. |
| 2018/0347194 | A1 | 12/2018 | Champion |
| 2019/0100920 | A1 | 4/2019 | Krause |
| 2019/0186139 | A1 | 6/2019 | Piltch |
| 2021/0071410 | A1 | 3/2021 | Kralic et al. |
| 2021/0079655 | A1 | 3/2021 | Swaya, Jr. |
| 2021/0102382 | A1 | 4/2021 | Shaw |
| 2021/0115670 | A1 | 4/2021 | Guerra |
| 2021/0131094 | A1 | 5/2021 | Cullen |
| 2021/0156150 | A1 | 5/2021 | Boss et al. |
| 2021/0222432 | A1 | 7/2021 | Anderson et al. |
| 2021/0222865 | A1 | 7/2021 | Beck et al. |
| 2021/0285218 | A1 | 9/2021 | Lowe |
| 2021/0301534 | A1 | 9/2021 | Svec et al. |
| 2021/0332539 | A1 | 10/2021 | Lee et al. |
| 2022/0059713 | A1 | 2/2022 | Selten et al. |
| 2022/0064955 | A1 | 3/2022 | Nelson, Jr. |
| 2022/0149771 | A1 | 5/2022 | Svec et al. |
| 2022/0173693 | A1 | 6/2022 | Atchley et al. |
| 2022/0298794 | A1 | 9/2022 | Tripod |
| 2022/0307262 | A1 | 9/2022 | Humphreys |

FOREIGN PATENT DOCUMENTS

| | | | |
|---|---|---|---|
| JP | 2013171873 | A | 9/2013 |
| WO | WO2012/120208 | A2 | 9/2012 |
| WO | WO2012/136194 | A2 | 10/2012 |
| WO | WO2013/099028 | A1 | 7/2013 |
| WO | WO2021/202327 | A1 | 10/2021 |

OTHER PUBLICATIONS

International Search Report and the Written Opinion of the International Searching Authority for PCT/US2021/024570, dated Jun. 29, 2021.

* cited by examiner 71
72
OR
61
61
61

64
66
63
61
65
62
65
68
67
69

INTERLOCKING LAMINATED STRUCTURAL ROOFING PANELS

REFERENCE TO RELATED APPLICATIONS

The present Patent Applications claims the benefit of U.S. Provisional Patent Application No. 63/001,561, filed Mar. 30, 2020, and claims the benefit of U.S. Provisional Patent Application No. 63/010,913, filed Apr. 16, 2020, and claims the benefit of U.S. Provisional Patent Application No. 63/061,832, filed Aug. 6, 2020.

INCORPORATION BY REFERENCE

The disclosures of U.S. Provisional Patent Application No. 63/001,561, filed Mar. 30, 2020, U.S. Provisional Patent Application No. 63/010,913, filed Apr. 16, 2020, and U.S. Provisional Patent Application No. 63/061,832, filed Aug. 6, 2020, are specifically incorporated by reference herein as if set forth in their entireties.

TECHNICAL FIELD

This disclosure relates generally to roofing systems and more specifically to roofing panels.

BACKGROUND

A need exists for large roofing panels that are sufficiently structurally robust to be attached to widely spaced roof rafters and support their own weight. Such roofing panels should be lightweight so that they can be handled and installed by a small crew or even a single person, yet strong enough to support themselves when attached to widely spaced rafters. It is to the provision of such roofing panels that the present disclosure is primarily directed.

SUMMARY

Briefly described, a roofing system is formed using interlocking laminated structural roofing panels that have an outer exposed side and an inner side that can face the interior of a structure when installed as part of a roof for the structure. The roofing panels are configured to act as a structural component of the roofing system that can be easily handled and installed by individual installers. In embodiments, the roofing panels are formed with a lightweight core sandwiched between layers of other materials, including at least a first layer of material, which can comprise wood, such as plywood, metal or a polymer, and at least a second layer of material, which can comprise wood, such as plywood, metal, or a polymer. Additional layers of materials also can be applied thereover. For example, in embodiments, a third layer of material, which can comprise a self-gripping metal, overlies and is secured to the first layer of material. In some embodiments, a fourth layer of material, which can comprise a self-gripping metal, underlies and can be mechanically secured to the second layer of material, or can be secured to the core.

In other embodiments, additional, e.g. fifth and/or sixth, layers of materials can be applied over the core and the first, second, third and/or further layers. For example, a thin layer of finished plywood or a veneer may underlie the fourth layer, which can comprise a self-gripping metal layer applied along the second layer or the core, to form a finished interior ceiling of a structure when the roofing panels are installed on a roof for the structure. In some embodiments, a layer of a waterproofing membrane may be disposed beneath or atop the third layer, which can comprise a self-gripping metal applied to the first layer or the core. The use of self-gripping metal materials for one or more of the layers applied to the core helps provide substantial structural strength to the roofing panels so that the roofing panels can support their own weight when spanned across and attached to widely spaced roof rafters. The roofing panels further may be interlocked for ease of installation and to provide additional structural integrity.

Thus, roofing panels are disclosed that meet the above referenced and other needs. In addition, aspects of the present disclosure include, without limitation, a roofing panel comprising a core having peripheral edges; a first layer of material overlying the core, the first layer of material having peripheral edges substantially aligned with the peripheral edges of the core; a second layer of material overlying the first layer of material, the second layer of material having peripheral edges substantially aligned with the peripheral edges of the core and comprising a moisture-resistant material; and a third layer of material overlying the second layer of material, the third layer of material having peripheral edges; wherein the third layer of material is offset with respect to the core such that a first peripheral edge of the third layer of material projects beyond a corresponding peripheral edge of the core, and a second peripheral edge of the third layer of material is inwardly displaced from another corresponding peripheral edge of the core to define an exposed strip of the second layer of material; and wherein the roofing panel is configured such that the first peripheral edge of the third layer of material overlaps an exposed strip of the second layer of material of an adjacent roofing panel when the roofing panel and the adjacent roofing panel are installed on a roof to interlock the roofing panel and the adjacent roofing panel together.

In embodiments, the roofing panel further comprises a fourth layer of material underlying and adhered to an inner surface of the core, the fourth layer of material having peripheral edges substantially aligned with the peripheral edges of the core; a fifth layer of material underlying and adhered to the fourth layer of material, the fifth layer of material having peripheral edges substantially aligned with the peripheral edges of the core; and a sixth layer of material underlying and adhered to the fourth layer of material, the sixth layer of material having peripheral edges, and the sixth layer of material being offset relative to the core so that at least one peripheral edge of the sixth layer of material projects beyond a corresponding peripheral edge of the core.

In embodiments, at least one peripheral edge of the sixth layer of material is inwardly displaced from a corresponding peripheral edge of the core to expose a strip of the fifth layer of material. In some embodiments, the fifth layer of material comprises double sided self-gripping metal.

In other embodiments, the sixth layer of material comprises plywood or veneer and is exposed to the inside of a building when the roofing panel is installed on a roof. In embodiments, the first layer of material and the fourth layer of material comprise plywood or veneer.

In embodiments of the roofing panel, the core comprises foam. For example, in embodiments, the core can comprise polyisocyanurate (ISO), polystyrene, PVC, polyethylene, polyamide, phenolic materials, or combinations thereof.

In other embodiments of the roofing panel, the first peripheral edge of the third layer of material and the exposed strip of the second layer of material of the like adjacent roofing panel overlapped thereby are attached by an adhesive, by bonding, by welding, or combinations thereof.

In still other embodiments of the roofing panel, the core comprises interlocking features including tongues projecting from two adjacent sides of the core and cooperating recessed channels defined along opposite adjacent sides of the core.

In another aspect of the present disclosure, a roofing panel comprises a core, and a plurality of layers of material including a first layer of material overlying the core and adhered thereto; and a second layer of material underlying the core and adhered thereto; wherein the core and at least some of the plurality of layers of material have a substantially rectangular configuration having a plurality of peripheral edges; wherein the first layer of material is offset with respect to the core so that at least a first peripheral edge of the first layer of material projects beyond a corresponding peripheral edge of the core and at least a second peripheral edge of the first layer of material is inwardly displaced from a corresponding second peripheral edge of the core to expose a strip of at least one layer of material below the first layer of material or a portion of the core; and wherein the first peripheral edge of the first layer of material is configured to overlap an exposed strip of an adjacent roofing panel when the roofing panel and the adjacent roofing panel are installed adjacent one another on a roof to interlock the roofing panel and the adjacent roofing panel together.

In embodiments, of the roofing panel, at least one of the plurality of layers of material comprises a layer of wood, and at least one of the plurality of layers of material comprises a layer of self-gripping metal configured to mechanically bond to the layer of wood. In some embodiments, the layer of self-gripping metal is offset relative to the core to form interlocking features.

In embodiments of the roofing panel, the core is configured with interlocking features. For example, the interlocking features can comprise tongues projecting from two adjacent sides of the core and cooperating recessed channels defined along opposite adjacent sides of the core.

In some embodiments, the first layer of material and the second layer of material each comprise wood, and the plurality of layers of material further comprise an outer layer of self-gripping metal mechanically bonded to the first layer of material, and an inner layer of self-gripping metal, mechanically bonded to the second layer of material.

In embodiments, the core comprises a thickness selected based upon a strength determined for a desired application of the roofing panel.

In some embodiments, each of the first layer of material and the second layer of material is coupled to the core with at least one of an adhesive, fastener, or combinations thereof.

In other embodiments of the roofing panel, the at least one layer of self-gripping metal is offset relative to the core to form interlocking features. For example, the at least one layer of self-gripping metal can be diagonally offset relative to the core to define projecting flanges along two adjacent sides of the panel and exposed strips along the other two sides of the panel.

In some embodiments of the roofing panel, the roofing panel also can include one outer layer of self-gripping metal and one inner layer of self-gripping metal, each layer being mechanically bonded to an adjacent wood layer applied to a surface of the core to form a structurally robust panel. Still further, the core of the roofing panel comprises a thickness selected based upon a strength determined for a desired application of the roofing panel; and the roofing panel can include a number of layers of materials arranged over the core to provide impact resistance.

In other embodiments, layers of a self-gripping metal material may be applied directly to one or more surfaces of a lightweight core material without intervening wood or other layers. For example, one or both of the first and second layers applied to opposite surfaces of the core can comprise a self-gripping metal material sheet. Self-gripping metal materials also may be embedded within the material of the core; and can include gripping features that may be bent or shaped to enhance the strength of the roofing panels, or can be bonded or otherwise attached to the core.

In other embodiments, covering or outer facing surface layers without gripping features, also can be applied to the core. Such covering layers can be directly attached to at least one surface of the core, without an intervening layer such as a wood, polymer or other material layer between the core surfaces and the covering layers. For example, in embodiments, the covering layers can include sheets or panels of a metal, polymer, and/or other materials (including composite material layers that can include continuous or discontinuous fibers, woven or non-woven textile materials, a fibrous mat or combinations thereof) adapted to be exposed to an outer environment, and can be mounted to the core with fasteners, or can be bonded, adhered, welded, or otherwise attached to one or more surfaces or faces of the core. In embodiments, the covering layers further can be mounted along the outward facing surfaces of the core in an oppositely and diagonally offset arrangement so as to overlap and extend past one or more of the side edges of the core, with the opposite side edges of the core uncovered so as to define recessed or exposed areas or side regions. The overlapped peripheral or side edge portions of the covering layers will overlie and engage corresponding exposed strips, areas or side regions of the core and can be secured thereto such as by fasteners, adhesives, bonding or other attachments, to interlock and connect the roofing panels in series across a roofing structure.

Other aspects of the present disclosure include a roofing panel comprising a core sandwiched between covering layers, wherein at least one of the covering layers comprises a metal or polymer material panel or sheet coupled to the core, with one of more peripheral edges of the at least one of the covering layers overlapping one or more corresponding side edges of the core. In embodiments, the metal or polymer material panel or sheet is coupled to the core with at least one of an adhesive, fastener, or combinations thereof.

Accordingly, embodiments of roofing panels and methods for forming a roof structure that are directed to the above discussed and other needs are disclosed. The foregoing and other advantages and aspects of the embodiments of the present disclosure will become apparent and more readily appreciated from the following detailed description and the claims, taken in conjunction with the accompanying drawings. Moreover, it is to be understood that both the foregoing summary of the disclosure and the following detailed description are exemplary and intended to provide further explanation without limiting the scope of the present disclosure.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

The present disclosure will be described generally before referring in additional detail to the various drawing figures attached hereto. In embodiments, a roofing panel is provided that has sufficiently robust structural integrity to be spanned across a substantial distance to form a roofing structure; for example, extending between widely spaced rafters or other supports without the need for underlying mid-span support rafters. The panel may be composed of a core and various layers, including a weather-exposed exterior surface and also may have an interior surface that is finished and serves as the ceiling of a building on which the panels are installed. The roofing panels are configured to be lightweight, including a foam core, and are easy to handle and install by a small crew or a single installer. The roofing panels further are configured with integrated interlocking features along their edges that are adapted to lock side-by-side and end-to-end roofing panels together to create a complete an interior and exterior roof.

The roofing panels, in one embodiment, each have a laminated or layered structure with a lightweight foam core sandwiched between outer and inner layers of other materials. At least one of the materials of the outer and inner layers will include a polymer, metal or wood such as a plywood, or wood veneer, and/or in combinations thereof. The term "wood" will be used herein to refer to these layers and it will be understood that this term includes polymer, plywood, wood veneer, and other materials to which self-gripping metal can bond mechanically. In embodiments, the layers applied to the core also may be covered with a butyl fire resistant membrane such as, for example, Versashield® Solo brand fire resistant slip sheet available from GAF of Parsippany, NJ. In embodiments, a layer of self-gripping metal is integrated with and adhered or bonded to the wood layer along the outer and inner sides of the roofing panel. In embodiments, the resultant roofing panel is sufficiently strong to span a large distance without the need for substantial support from underlying roof rafters.

Self-gripping metal sheets are thin gauge sheet metal with a plurality of mechanically extruded or gouged-out hooks on one or both of its surfaces. In some embodiments, the self-gripping metal sheets can have 30 to 200 mechanically extruded or gouged-out hooks per square inch. When pressed onto a material such as wood, the hooks penetrate and grip the wood to secure the self-gripping metal sheet to the wood. The self-gripping metal sheet thus becomes firmly bonded to the wood or other material to form an integrated metal surface. An example of self-gripping metal sheets are products available from the Trip Metal Corporation of Wolcott, Connecticut marked under the brand name Grip Metal®.

Figure 1:
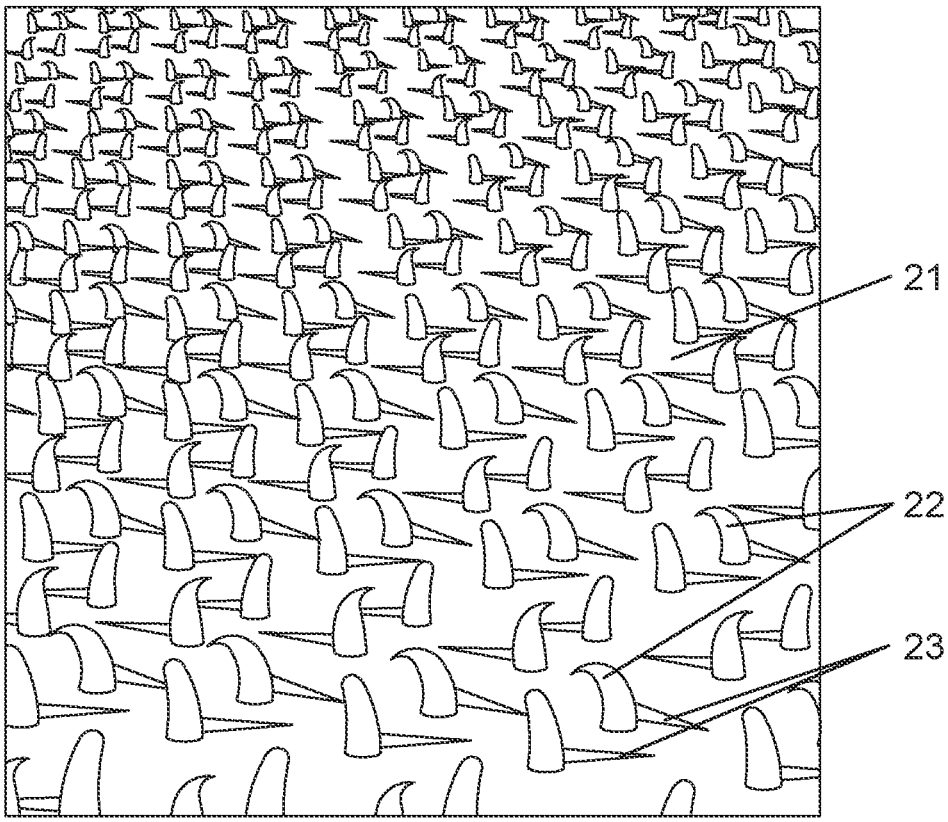
FIG. 1 is a photograph of the surface of a self-gripping metal material showing the multitude of gripping hooks formed in the surface.

FIG. 1 illustrates the surface 21 of a sheet of self-gripping metal showing a plurality of tiny gripping hooks 22 mechanically extruded or mechanically gouged from the metal. Gouges 23 are visible from where each hook has been created. Additional details about this product may be found at www.gripmetal.com. This material will be referred to herein for clarity as self-gripping metal and self-gripping metal layers. The present disclosure is not limited to and specific brand or configuration of such products.

In one embodiment, the self-gripping metal layers or other layers are oppositely and diagonally offset from the core of the panel in a manner as indicated in, for example, FIGS. 2-5, to create projecting flanges on two sides of each roofing or exposed panel and cooperating insets defining exposed strips on the other two sides. These comprise interlocking features of the roofing panels. When the roofing panels are installed side-by-side and end-to-end, the projecting flanges and the exposed strips of adjacent roofing panels overlap and are pressed together so that they bond mechanically by virtue of the self-gripping metal. This locks adjacent roofing panels together. In another embodiment (FIGS. 5-7), the core is configured to define tongues projecting from two sides of each roofing panel and cooperating grooves on the other two sides. During installation, the tongues of each roofing panel fit into the grooves of adjacent panels to align and interlock the roofing panels together.

In an embodiment, one or more wood layers are adhered to a paper facer applied along a lightweight foam core. Alternately, the wood layers may be applied directly to the core without or in place of a paper facer during manufacture of the core. In some embodiments, a butyl or other type of membrane may be interposed in the layered structure of the roofing panel. In embodiments, the alternately offset self-gripping metal and wood layers will interlock with each other and to the butyl surface and create a water resistant structure whereby migration water through seams defined between the side edges of adjacent roofing panels is substantially deterred.

In embodiments, the roofing panels may have cores made with various thicknesses of lightweight foam board depending on application and desired strength. In some embodiments, the core thickness is 0.75 inches to 12 inches. In other embodiments, the core thickness is 0.75 inches to 10 inches; 0.75 inches to 8 inches; 0.75 inches to 6 inches; 0.75 inches to 5 inches; 0.75 inches to 4 inches; 0.75 inches to 3 inches; 0.75 inches to 2 inches; 0.75 inches to 1 inches. In other embodiments, the core thickness is 1 inch to 12 inches; 2 inches to 12 inches; 3 inches to 12 inches; 4 inches to 12 inches; 5 inches to 12 inches; 6 inches to 12 inches; 8 inches to 12 inches; 10 inches to 12 inches. Additionally, in embodiments, the core thickness is 1 inches to 10 inches; 2 inches to 8 inches; 2 inches to 6 inches; 3 inches to 7 inches; 4 inches to 6 inches. Other thickness of the core also can be provided.

In embodiments, a waterproofing membrane or layer may be laid on the exposed surfaces of installed roofing panels to form a waterproof barrier. Alternatively, each roofing panel may have an exposed waterproof membrane applied to its exposed surface and seams between adjacent roofing panels can be taped or otherwise sealed after installation. In embodiments, the layers of the roofing panels may include a flat sheet of sheet metal of aluminum that is fastened by adhesive to adjacent layers.

FIGS. 2-13 show examples of roofing panels that embody principles of the present disclosure. Dimensions may be exaggerated in the figures to reveal details, and the figures are not drawn to scale.

Figure 3:
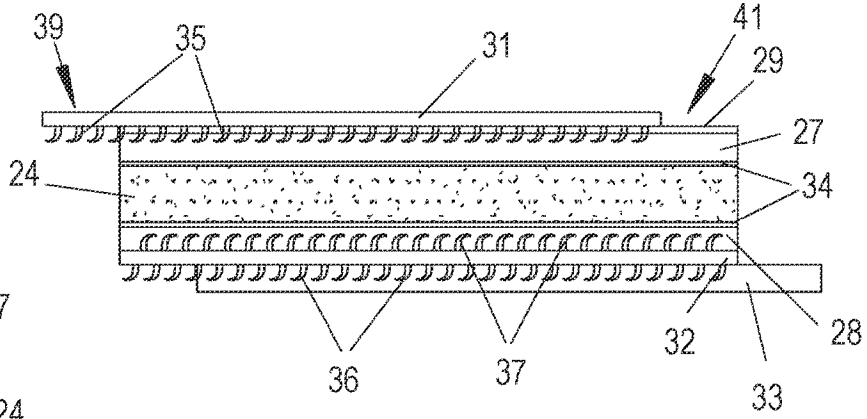
FIG. 3 is a side elevational view of the assembled roofing panel of FIG. 2 showing offset layers forming interlocking features along edges of the roofing panel.
Figure 2:
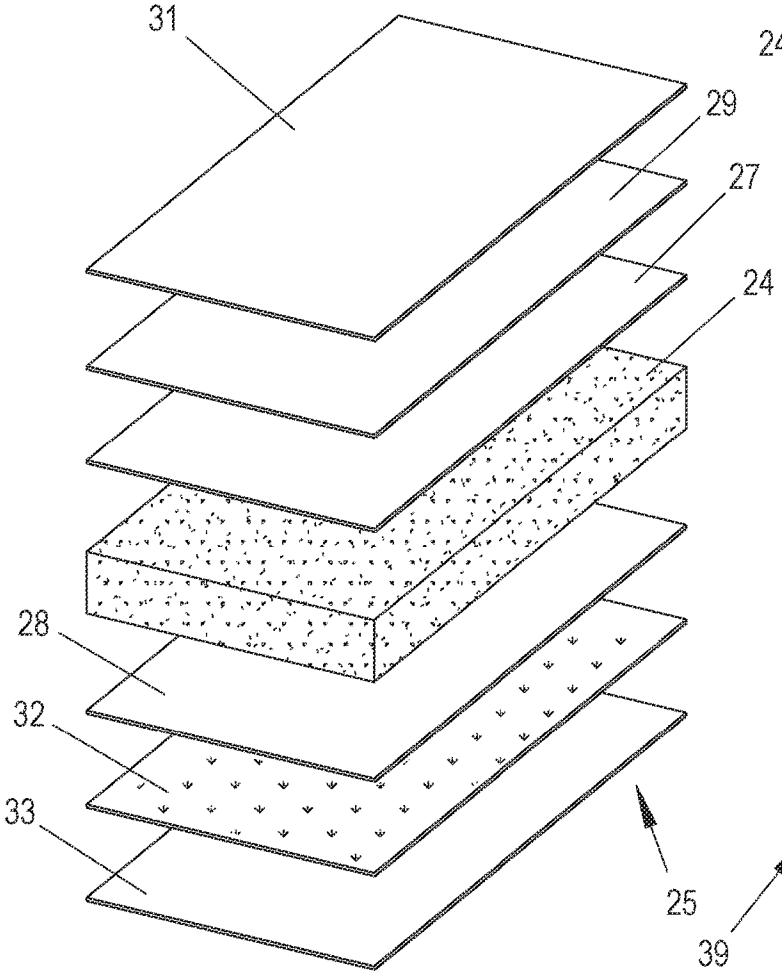
FIG. 2 is an isometric exploded view of one example embodiment of a roofing panel according to principles of the present disclosure.

FIG. 2 shows one embodiment of the layered structure of a roofing panel 25 according to the present disclosure. A panel core 24 is made of a lightweight material such as a foam, one example being a polyisocyanurate (ISO) or similar material. Other non-limiting examples of the lightweight material for the panel core include polystyrene, PVC, polyethylene, polyamide, and/or phenolic material. A plurality of layers are applied to the upper and lower surfaces of the core in a stacked, overlying arrangement as shown in FIGS. 2-3. For example, a first layer, which can include an upper layer of wood 27, is adhered to the upper surface of the core with adhesive 34 (FIG. 3). The first layer also can be attached to the core 24 by welding or otherwise bonding it to the core. A second layer, which can include a membrane material 29, is adhered to the upper surface of the wood layer 27. The membrane 29 may comprise a fire resistant membrane, such as the aforementioned Versashield® Solo, and/or a polymer membrane such as a thermoplastic polyolefin (TPO) material, with other desirable properties such as water-proofing. A third layer, shown in the present embodiment as upper layer 31 of self-gripping metal having gripping hooks 35 (FIG. 3), is pressed onto the panel such that its hooks 35 penetrate, grip, and bond to the wood layer 27.

Additional layers applied to the core can include a fourth layer, which, in embodiments, can comprise a lower layer of wood 28 adhered to the lower surface of the core 24 with an adhesive 34 (FIG. 3). A fifth layer, which can comprise a double sided self-gripping metal layer 32, can be pressed into the wood layer 28 so that its upper hooks 37 penetrate, grip, and bond to the wood of layer 28. In this embodiment, a sixth layer that can include a layer of a decorative material 33, such as a finished wood veneer, further may be attached to the other side of the dual sided self-gripping metal layer so that the lower hooks 36 of the self-gripping metal layer 32 penetrate, grip, and bond to the decorative material 33.

Figure 4:
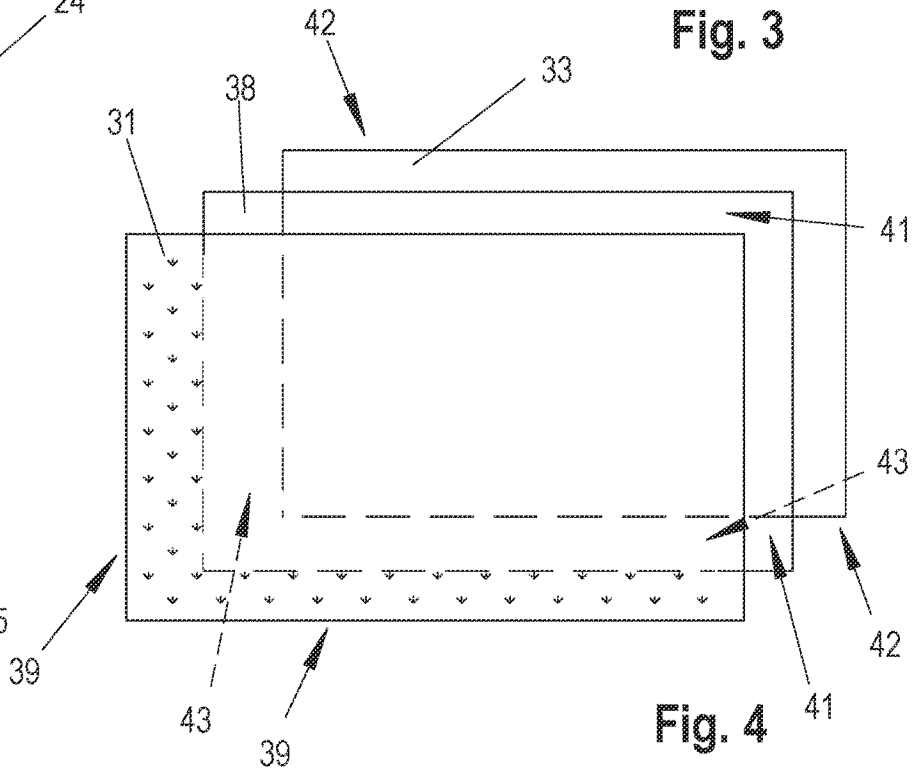
FIG. 4 is a plan view of the roofing panel of FIG. 3 showing the oppositely and diagonally offset layers forming interlocking features.

FIGS. 3 and 4 illustrate an embodiment of the interlocking features the roofing of panel of FIG. 2 according aspects of the present disclosure. Referring to both figures, the upper layer 31 of self-gripping metal is seen to be diagonally offset from the inner layers 38, e.g. the wood (first) layer and the membrane (second) layer of the roofing panel. In this way, the self-gripping metal layer 31 forms projecting upper flanges 39 around two adjacent sides of the roofing panel and complementary insets defining exposed strips 41 of the membrane 29 and/or the wood layer 27 along the other two adjacent sides of the roofing panel. Similarly, the lower layer of wood 33 is oppositely diagonally offset from the core and inner layers 38 to form projecting lower flanges 42 along two adjacent sides of the panel and complementary insets defining exposed strips 43 of the lower wood layer 28 along the other two adjacent sides.

The widths of the flanges and insets is exaggerated in these figures for clarity. By way of non-limiting example, in use, the flanges and insets may be from 1 to 5 inches wide, from 1 to 4 inches wide, from 1 to 3 inches wide, from 1 to 2 inches wide, from 0.5 to 5 inches wide, from 0.5 to 4 inches wide, from 0.5 to 3 inches wide, from 0.5 to 2 inches wide, from 0.5 to 1 inch wide, or other widths. The flanges and insets form interlocking features as described in more detail below.

Figure 7:
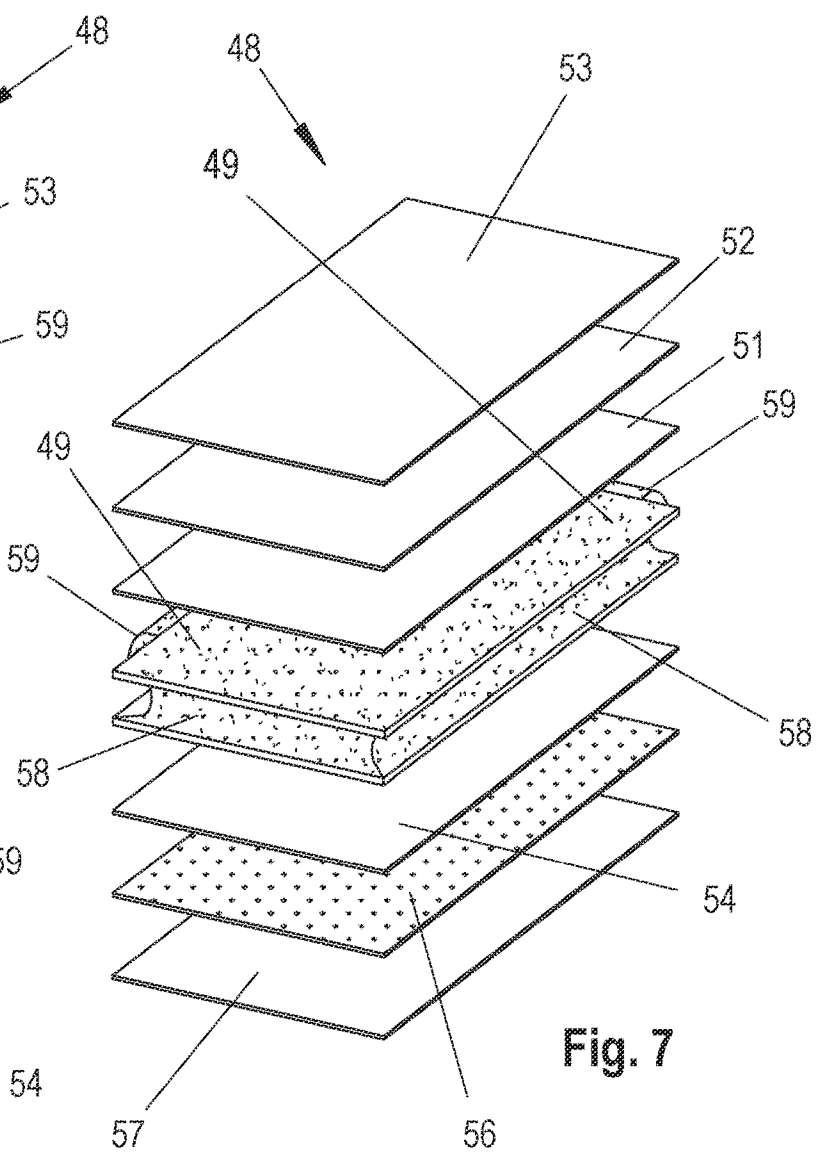
FIG. 7 is an isometric exploded view of the roofing panel of FIG. 5.
Figure 5:
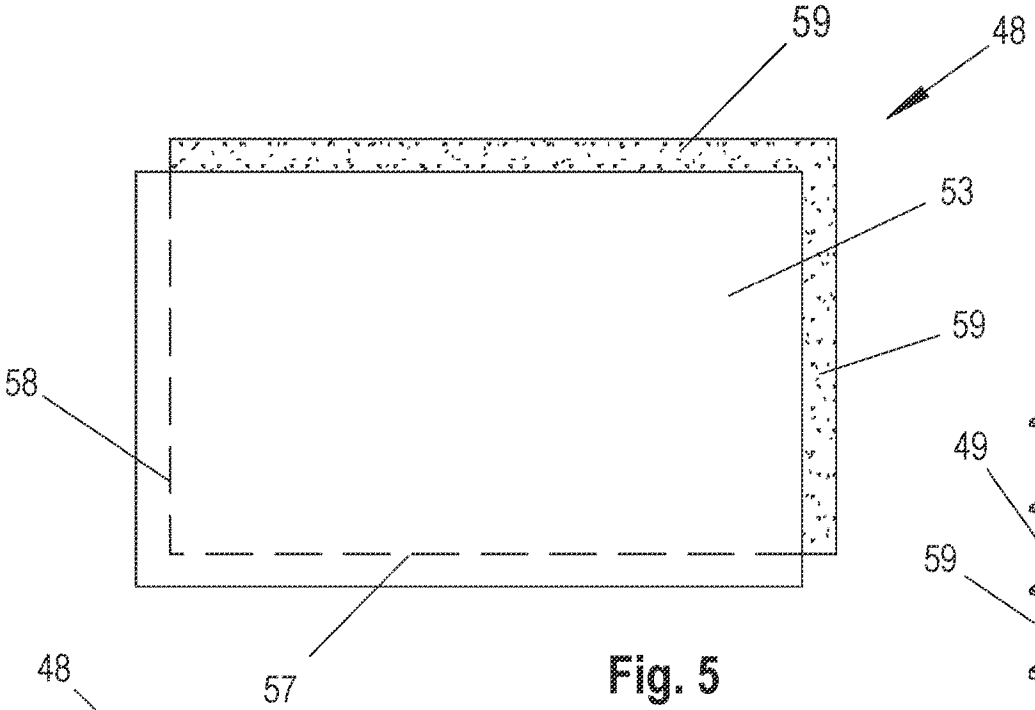
FIG. 5 is a plan view of an alternate embodiment of a roofing panel in which the core is configured to form the interlocking features of the roofing panels.
Figure 6:
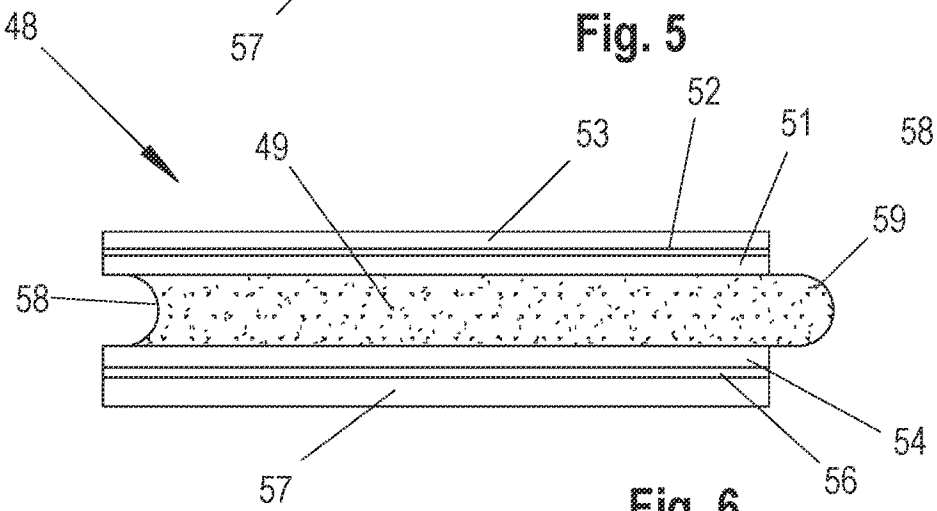
FIG. 6 is a side elevational view of the roofing panel of FIG. 5 showing one example configuration of the core.

FIGS. 5-7 show an example of an alternate embodiment of a roofing panel 48 according to aspects of the present disclosure. In this embodiment, interlocking features are formed by the lightweight core of the panels. Referring to these three figures simultaneously, roofing panel 48 has a lightweight foam core 49. The core 49 is sandwiched between a plurality of layers of material including, in this embodiment, an upper wood layer 51 adhered to the core, a membrane layer 52 portioned along the upper wood layer 51, and a layer of self-gripping metal 53 with gripping hooks (not shown) on its underside. Below the core is a wood layer 54, a layer of dual-sided self-gripping metal 56, and a decorative layer 57 that will be exposed on the interior of a building.

In this embodiment, the core 49 is formed with outwardly projecting tongues 59 on two adjacent sides and inwardly projecting recesses 58 on the other two adjacent sides. During installation of roofing panels in side-by-side and end-to-end relationships, the tongues 59 fit into the grooves 58 of adjacent roofing panels to align the roofing panels and interlock them together.

Figures 8, 8A, 9:
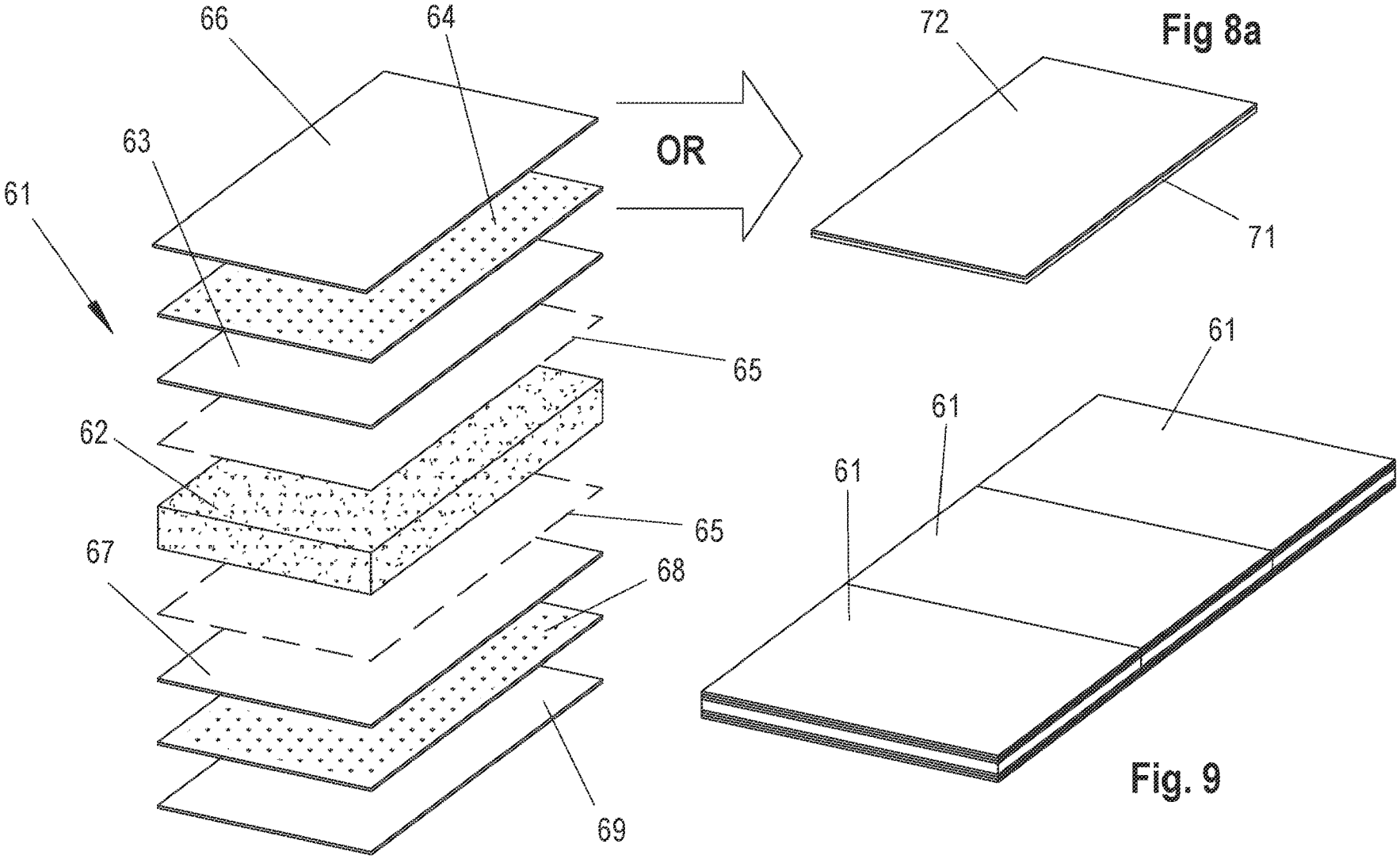
FIG. 8 is an isometric exploded view of another embodiment of the roofing panels according to principles of the present disclosure.
FIG. 8*a* is an isometric view of an alternate embodiment of an outer most, exposed layer of the roofing panel of FIG. 8
FIG. 9 is an isometric view showing three roofing panels aligned in side-by-side relationship on a roof.

FIGS. 8-9 show an example of a slightly different embodiment of a lightweight structural roofing panel 61 according to aspects of the present disclosure. The roofing panel 61 has a lightweight core 62 having wood layers 63 and 67 secured to the core with adhesive 65. In FIG. 8, an upper dual-sided self-gripping metal layer 64 is pressed into and grips the wood layer 63 and an outer wood layer 66 is pressed onto and becomes securely gripped by the self-gripping metal layer 64. FIG. 8*a* shows an alternative to the top two layers of FIG. 8, utilizing a single-sided self-gripping metal layer 71 secured to the wood layer 63 with a protective layer of a membrane material 72 bonded to the upper side of the single-sided self-gripping metal 71. In either case, the result is a lightweight roofing panel with superior strength that can span widely spaced rafters with little or no mid-span support.

The embodiment of the roofing panels 61 shown in FIGS. 8-9 may have interlocking features such as discussed above relative to other embodiments. In FIG. 9, three roofing panels 61 are shown installed in side-by-side relationship to form a longer span of roofing panels. For instance, but not by way of limitation, if the roofing panels 61 are 19 inches on each side, the resulting roofing panel shown in FIG. 9 would be 19 inches wide by 57 inches long. Of course, each single roofing panel may be manufactured to have these or similar or any other desired dimensions so long as the roofing panels remain lightweight, easy to install, and structurally robust.

Figure 10:
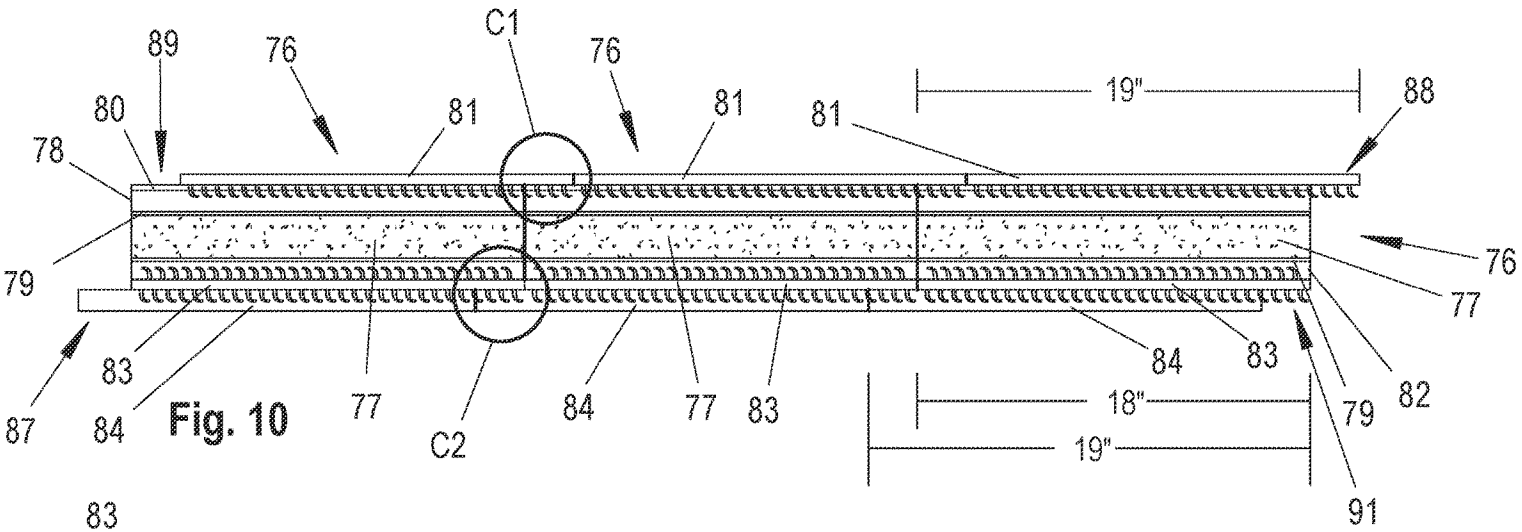
FIG. 10 is an end elevational view of the side-by-side roofing panels of FIG. 9, showing one embodiment of the interlocking features that secure the roofing panels to each other.

FIG. 10 shows three roofing panels of the type shown in FIGS. 2-4 interlocked together in side-by-side relationship and shows more clearly the interaction of the interlocking features. The roofing panels 76 have a single-sided self-gripping metal layer 81 as a top surface and these metal layers are shifted as discussed above to form projecting flanges 88 and offsets 89, which comprise interlocking features. Each of the roofing panels 76 has a core 77 sandwiched between an upper wood layer 78 secured to the core with adhesive 79 and a lower wood layer 82 secured with adhesive 79.

In this embodiment, a dual-sided self-gripping metal layer 83 is secured to the wood layer 82 by virtue of its gripping hooks. Interior wood panels 84 are secured to the other side of the dual-sided self-gripping metal layer 83 by virtue of the self-gripping panel's lower gripping hooks. The interior wood panels 84 are shifted relative to the core layers to form projecting interlocking flanges 87 and insets defining exposed strips 91, which comprise interlocking features. The flanges 88 and the insets 91 each have downwardly projecting gripping hooks and the flanges 87 and offsets 89 do not have gripping hooks.

As shown in circles C1 and C2, when two roofing panels are abutted sided-by-side and are pressed together along the resulting seam between adjacent roofing panels, the gripping hooks of the flanges 88 become embedded in the wood layer 78 along the offset 89. Likewise, the gripping hooks of the insets 91 become embedded in the lower wood layer (e.g., interior wood panels 84) along the flanges 87. This securely interlocks the two adjacent panels together along the seam defined therebetween to form a single monolithic and very strong structure. End-to-end roofing panels will interlock in the same way on a roof due to the diagonal offsets of the upper self-gripping metal layers 81 and the lower wood layers (e.g., interior wood panels 84). The result is an integrated, interlocked roof covering of exceptional structural integrity made of lightweight panels that can be installed easily by a small installation crew or a single installer.

Figure 11:
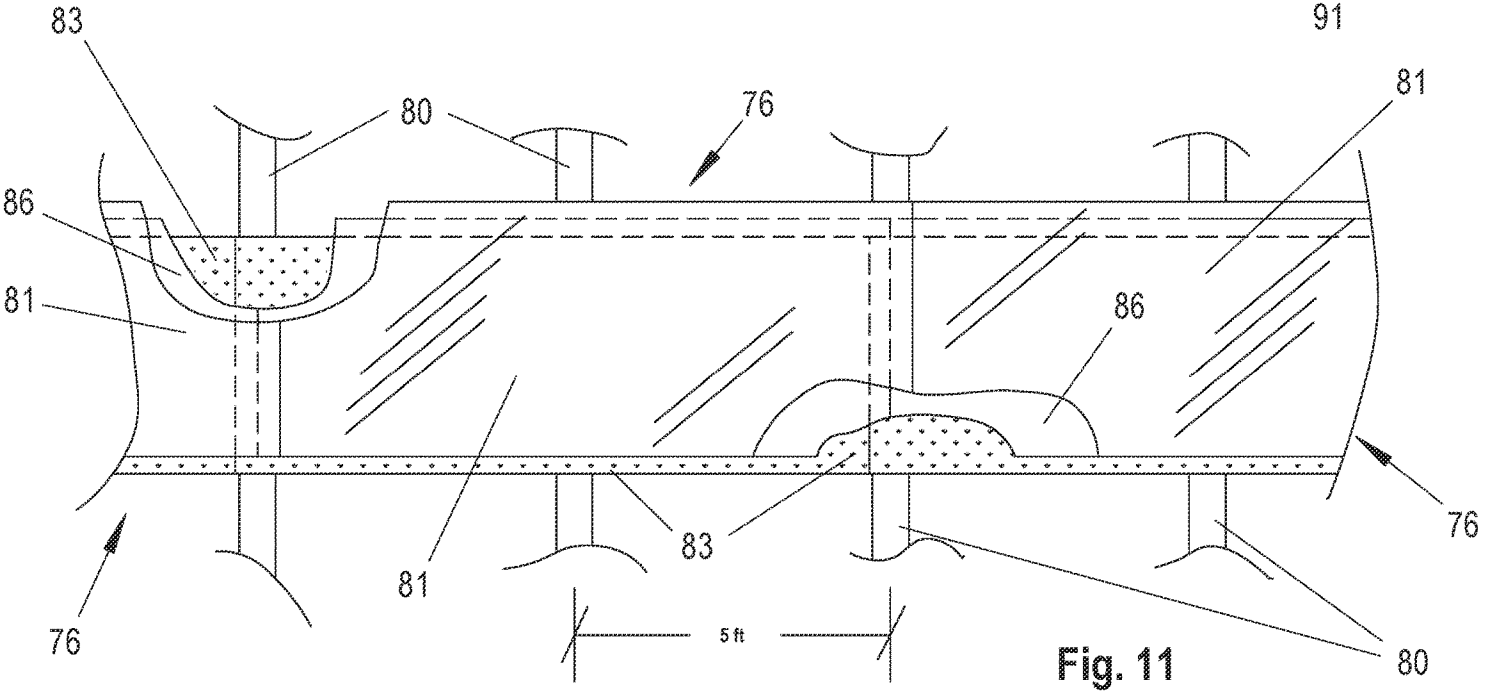
FIG. 11 is a plan view of the side-by-side roofing panels of FIGS. 9-10 installed atop widely spaced roof rafters with cutout sections revealing various layers of the panels.

FIG. 11 is a top view of roofing panels 76 installed side-by-side on spaced apart roof rafters 80. The roof rafters 80 may be widely spaced compared to the standard 16 inch on center spacing for traditional roofs. FIG. 11 indicates roof rafters 80 that are spaced 5 feet apart implying roofing panels 76 that are 10 feet long. However, these example dimensions are not limiting and any combination of rafter spacing and panel length may be selected to suit a particular need. The seams between adjacent roofing panels are seen to fall on an underlying rafter and, in this example, a mid-span rafter underlies the center of each roofing panel. The cutout sections in FIG. 11 reveal the upper self-gripping metal layer 81, the interior panel layers 86, and the top surface of the lower dual-sided self-gripping metal layer 83.

Figure 12:
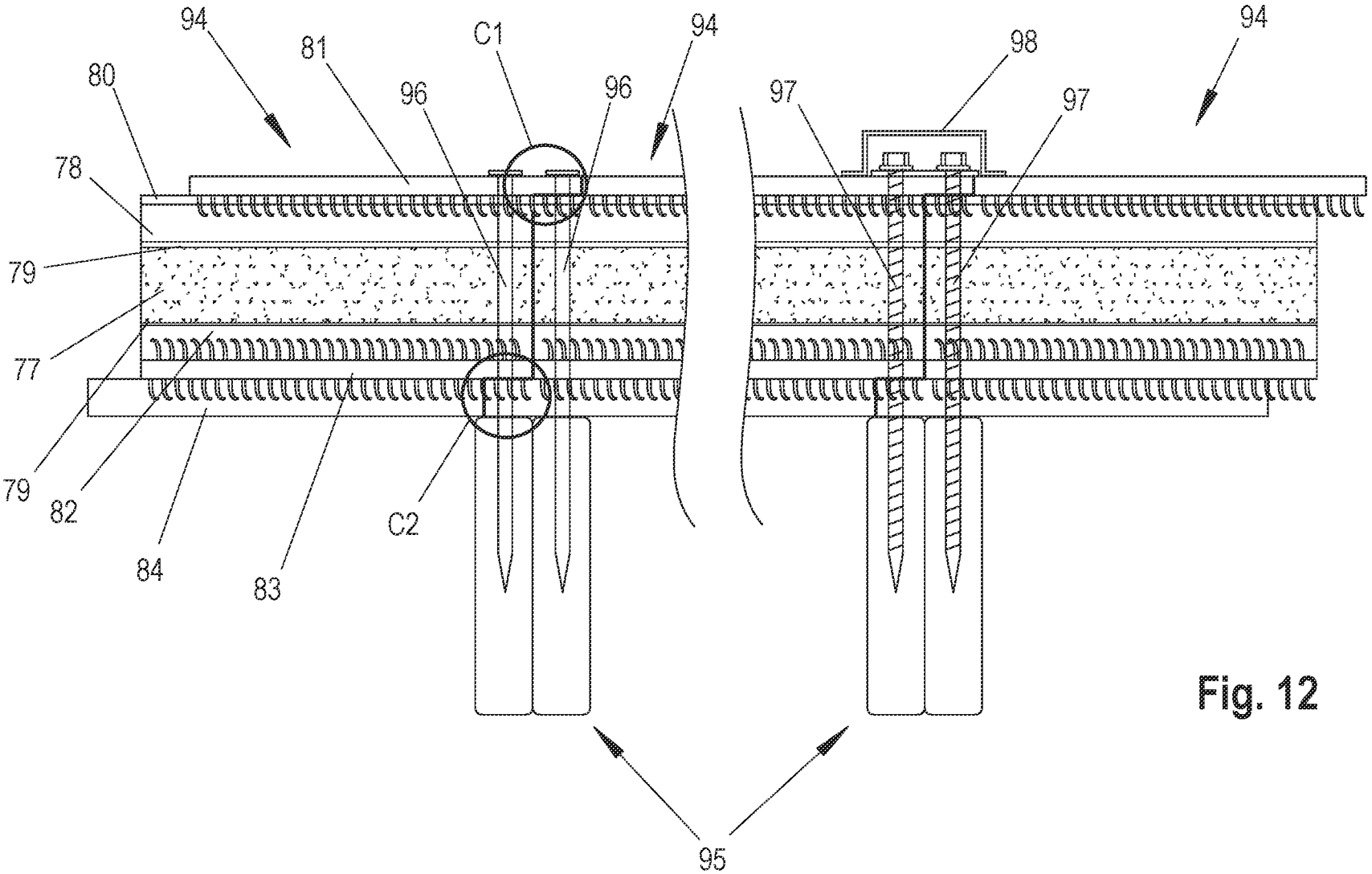
FIG. 12 is an elevational view showing three side-by-side panels attached to underlying roof rafters with fasteners.

FIG. 12 is a side elevational view showing examples of how the roofing panels of this present disclosure may be attached to underlying rafters. Rafters 95, which in this example are double rafters, underlie the seams between adjacent roofing panels 94. As before, the roofing panels 94 have cores 77, an upper wood layer 79, a membrane layer 80, and an upper self-gripping metal layer 81. Beneath the core is a lower wood layer 82, a dual-sided self-gripping metal layer 83, and a bottom wood layer 84.

Fasteners such as nails 96 (shown on the left) or screws 97 (shown on the right) are driven through adjacent panels adjacent the shown seams defined between adjacent roofing panels. More specifically, as accentuated by circles C1 and C2, each fastener extends through one of the interlocking features formed by overlapping projecting flanges and insets. The right fastener extends through the overlapping interlocking features at the tops of the roofing panels and the left fastener extends through the overlapping interlocking features at the bottoms of the roofing panels. As a result, not only are the roofing panels 94 interlocked securely together by means of the interlocking hooks of the interlocking features, the roofing panels 94 are further secured by fasteners that extend through these features and into underlying roof rafters 95. On the right in FIG. 12, a cover or cover strip 98 is installed over the heads of the fasteners to prevent leaks at their puncture locations.

Figure 13:
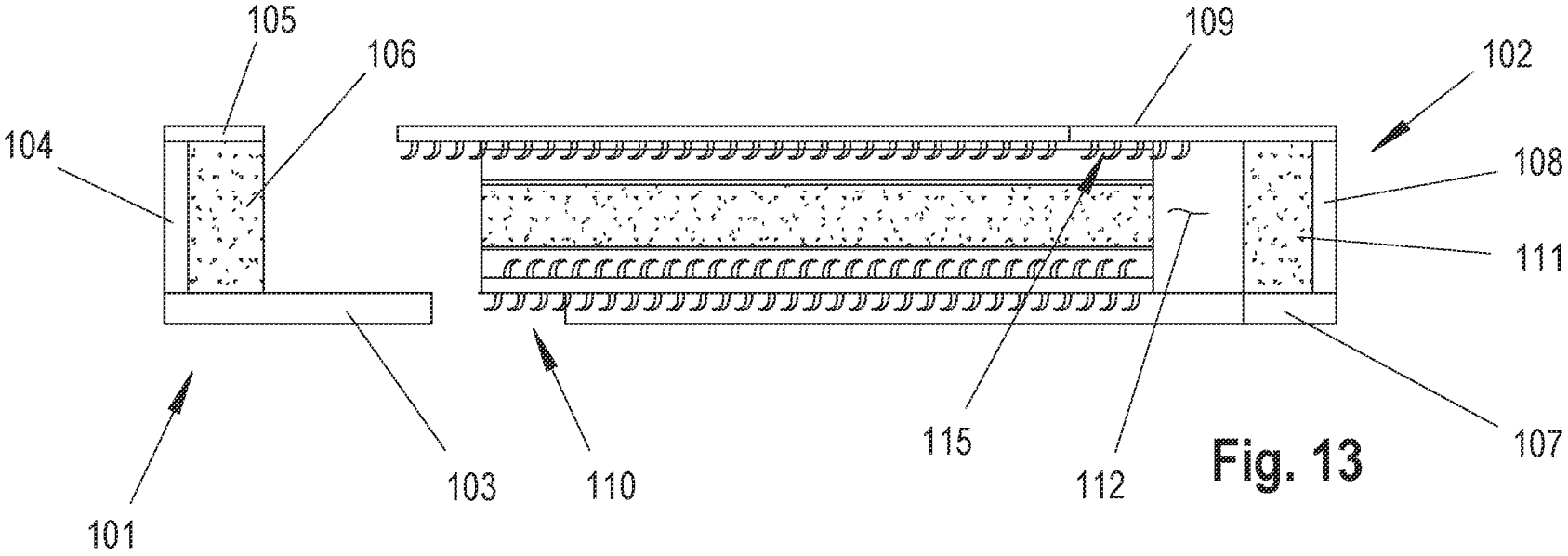
FIG. 13 is a partially exploded elevational view of example embodiment of end caps for finishing exposed ends of an installation of roofing panels.

FIG. 13 shows one example of end caps that may be used to cover and finish exposed ends of roofing panels in an installation. End cap 101 has a frame made of a bottom leg 103, a side leg 104, and a top leg 105. The end cap 101 may be filled with core material 106, any other appropriate material, or no material at all. The bottom leg 103 is sized to fit in the bottom inset 110 of a roofing panel such that the lower gripping hooks within the offset can grip and bond to the bottom leg 103 to hold the end cap 101 in place along a peripheral side edge of the roofing panels.

Similarly, end cap 102 has a frame comprising a top leg 109, a side leg 108, and a bottom leg 107. The top leg 109 may be made of self-gripping metal and has downwardly projecting gripping hooks projecting from the top leg's 109 underside. The top leg 109 is sized to fit into the top inset 115 such that the gripping hooks of the top leg 109 bond to the upper wood layer at the floor of the inset 115 of the roofing panel. This secures the end cap 102 to the opposite peripheral side edge of the roofing panel. In each case, a channel 112 may be formed for ventilation, wiring, drainage, or other uses.

Figure 14:
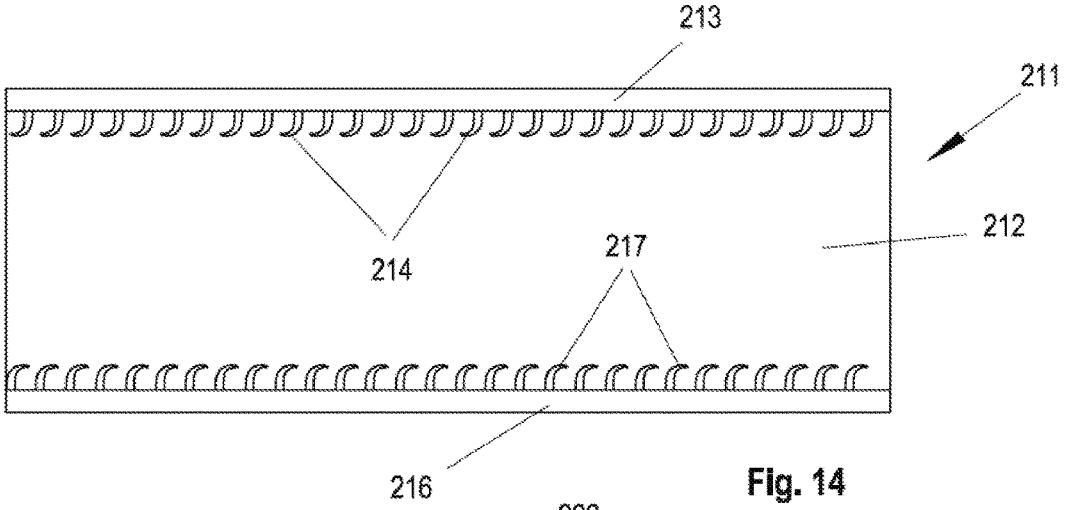
FIG. 14 is an elevational view of another embodiment of a roofing panel according to aspects of the present disclosure.

FIG. 14 illustrates an embodiment of a roofing panel 211 that does not include layers of wood or other material. In this embodiment, a lightweight core 212 formed from a material such as an ISO foam board or other appropriate material has self-gripping metal layers or panels 213 and 216 secured to each surface of the lightweight core 212. More specifically, the self-gripping metal layers 213 and 216 have corresponding hooks 214 and 217 securely embedded within the material of the lightweight core 212. In one embodiment, the hooks 214 and 217 are embedded in the lightweight core 212 before the material of the lightweight core 212 completely cures or as the lightweight core 212 is forming to create an extremely strong bond. The result is a light weight roofing panel that is sufficiently strong to be walked on when attached to roof rafters, that is easy to handle and install, and that is lighter than embodiments with a core, layers of wood, and self-gripping metal layers.

Figure 15:
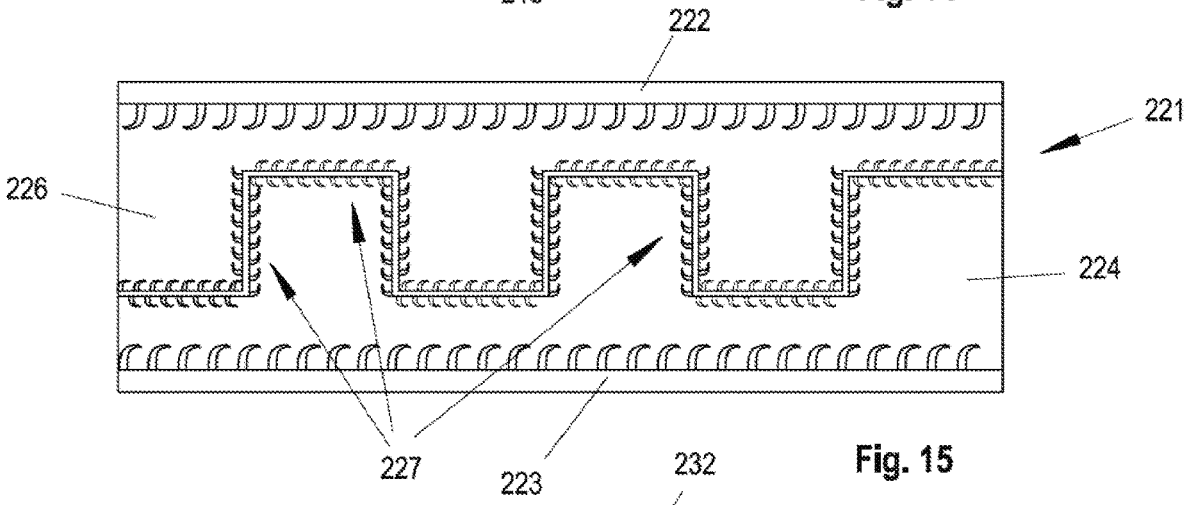
FIG. 15 is an elevational view of another embodiment of a roofing panel according to aspects of the present disclosure.

Single or double sided self-gripping metal layers also can be embedded within the material of the lightweight core to create a center structure that resists bending and thus increases the strength of a roofing panel. The center structure can be formed in situ as part of the process of forming the core so that it is securely bonded by its hooks to the surrounding core material. FIG. 15 shows one embodiment of a roofing panel 221 with a lightweight ISO foam core 224, 226 with self-gripping metal layers 222 and 223 bonded to each surface. A double sided self-gripping metal center structure 227 is embedded within the material of the core. In this embodiment, the self-gripping metal of the center structure is bent into a "square wave" pattern, which imparts superior bending resistance to the panel 221, particularly along the direction of the bends.

Figure 16:
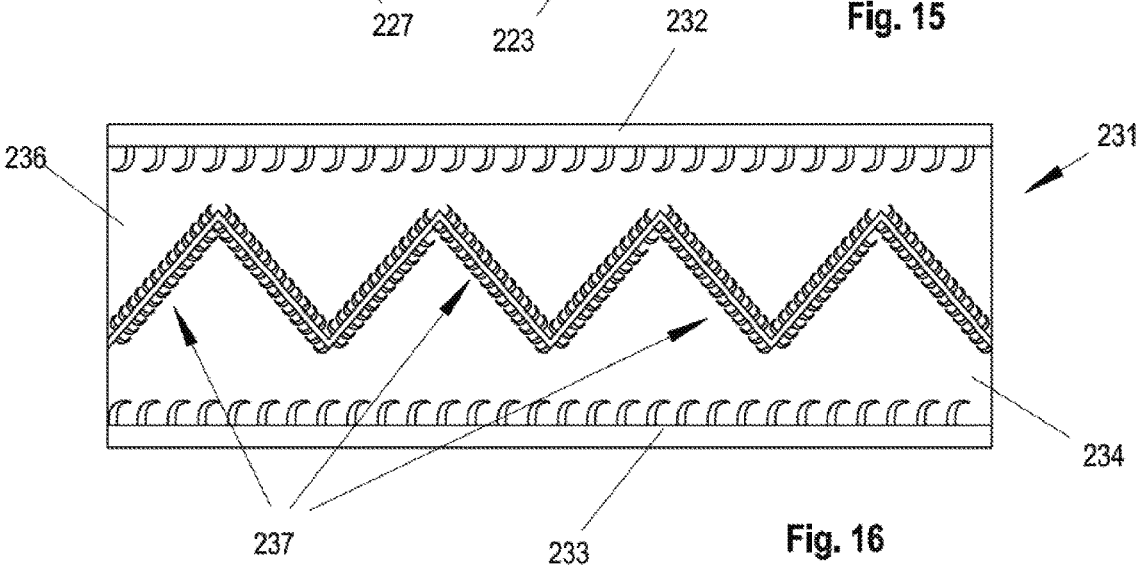
FIG. 16 is an elevational view of yet another embodiment of a roofing panel according to aspects of the present disclosure.
Figure 17:
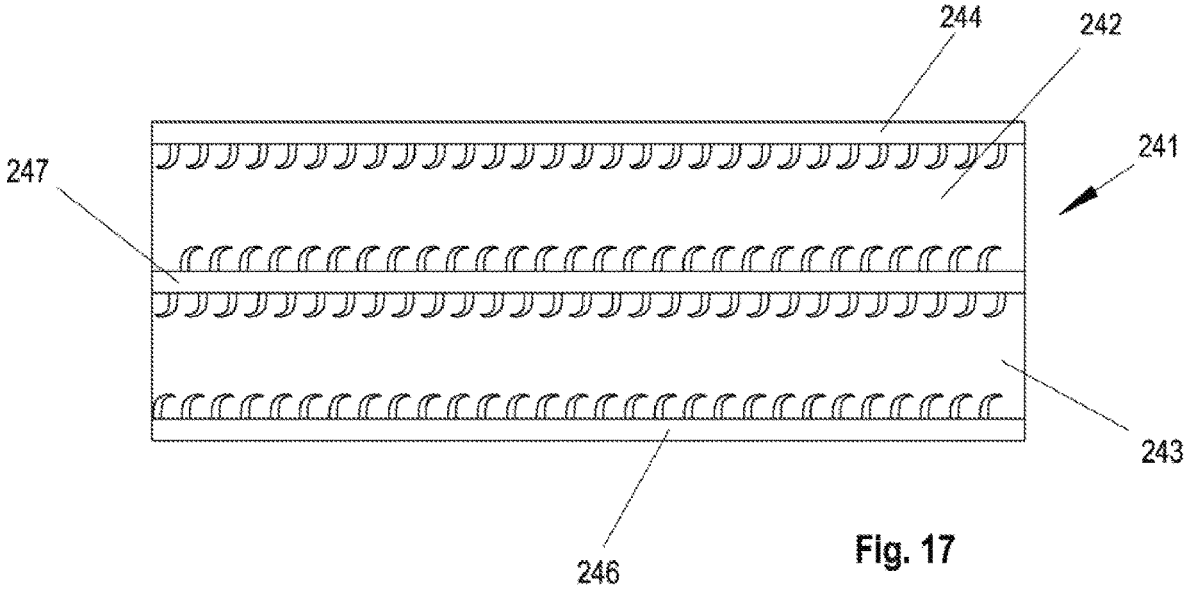
FIG. 17 is an elevational view of still another embodiment of a roofing panel according to aspects of the present disclosure.

In FIG. 16, a structural roofing panel 231 has a lightweight central core 234, 236 with self-gripping metal layers 232 and 233 securely bonded to its surfaces with hooks. In this embodiment, a double sided self-gripping metal layer or sheet 237 is embedded within the material of the core and is bent into a "saw tooth" pattern to provide enhanced strength and resistance to bending. In the embodiment of FIG. 17, roofing panel 241 has a lightweight core 242, 443 with self-gripping metal layers 244 and 246 securely bonded to its surfaces with hooks. A flat double sided self-gripping metal layer 247 is embedded in the material of the lightweight core and is secured in the material via hooks thereby enhancing the strength and bending resistance of the roofing panel 241.

Figure 18:
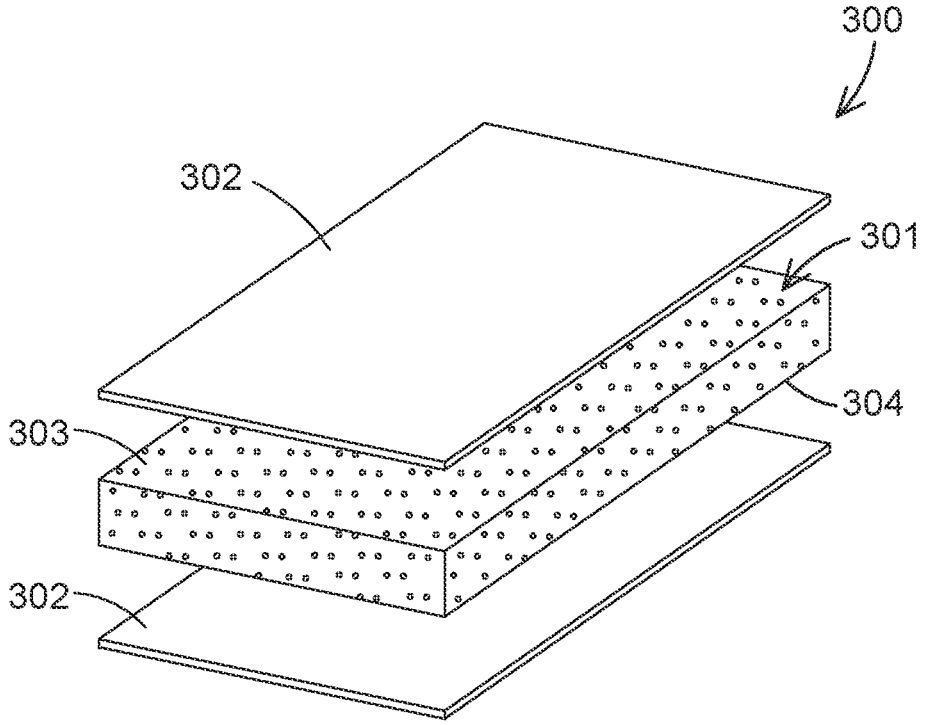
FIG. 18 is an exploded perspective view of a further embodiment of a roofing panel according to aspects of the present disclosure.
Figure 19:
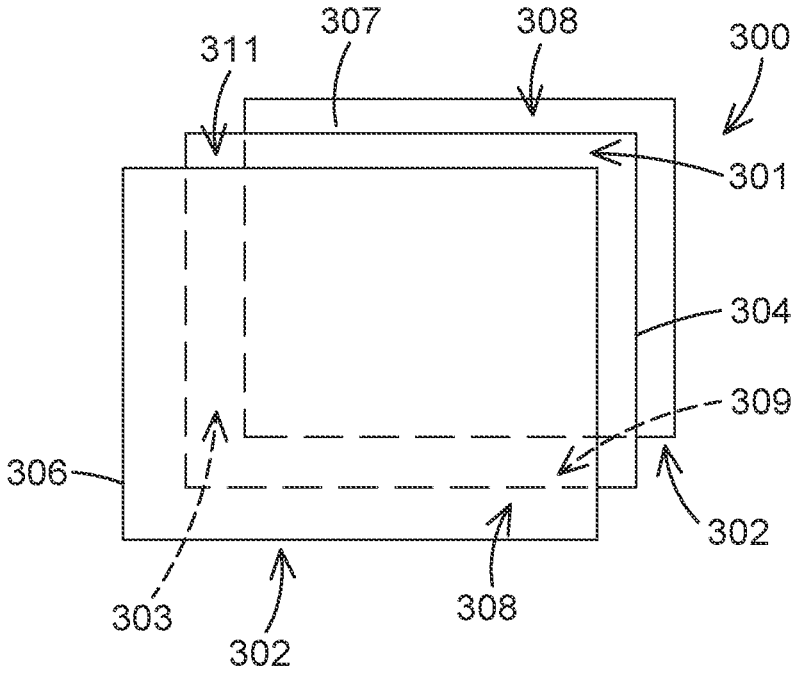
FIG. 19 is a plan view of the roofing panel of FIG. 18 showing the core and the oppositely and diagonally offset outermost layers forming interlocking features for engagement and interlocking with adjacent roofing panels.

Still further, in other embodiments such as illustrated in FIGS. 18-19, a roofing panel 300 can include a lightweight core 301 of a material such as an ISO foam board, or other appropriate, lightweight structural supporting material, with outer facing covering layers 302 secured to one or both of the opposed, upper and lower facing surfaces 303/304 of the core 301. The covering layers 302 can comprise metal or polymer sheets or panels, or can include sheets or panels of other materials such as composite material layers that can include continuous or discontinuous fibers, woven or non-woven textile materials, fibrous mat materials or combinations thereof, and which can include binder materials or coatings. The covering layers further will be adapted to be exposed to an outside environment, including exposure to rain, snow, heat and cold, UV light, wind and other environmental conditions.

The covering layers will be attached to at least the upper facing surface 303 of the core 301, for example, by application of adhesive materials between inward facing surfaces 306/307 of the covering layers 302 and the surfaces 303/304 of the core. The covering layers also can be attached to the cores by engaging the sheets and core with fasteners, such as rivets, screws, or other fastening mechanisms, or by bonding. In some further embodiments, the covering layers also can be applied to the core before the material of the core is completely cured, or as the core is being formed, and as the core is cured, the covering layer sheets or panels can be secured thereto.

As also shown in FIG. 19, one or more peripheral or side edge portions 308 of the covering layers can be applied in an overlapping or a substantially offset manner so that one or more of the peripheral side edge portions or flanges 308 of the covering layers are oppositely and diagonally offset from and extend outwardly past corresponding side edges 309 of the core. During installation, the overlapping peripheral or side edge portions 308 or the covering layers 302 can fit over and/or interlock with recessed or exposed side edge portions or strips 311 of the cores of adjacent roofing panels 300 form an overlapping seam or area of interlocking engagement therebetween. Fasteners, adhesives or other attachment materials further can be applied along the seams defined between the overlapping peripheral or side edge portions of the covering layers and the exposed or recessed side portions of the next adjacent roofing panels to secure the panels in interlocked series across a roof structure.

As further illustrated in FIGS. 18 and 19, the covering layers 302 do not require the use of gripping features, such as gripping hooks or other engaging features to secure the covering layers 302 to their cores 301, e.g. such as shown in the embodiments of FIGS. 14-17. In some further embodiments, however, as an alternative or an additional feature, hooks, studs or other gripping features can be applied along selected or limited portions of the covering layers to help facilitate the interlocking or engagement between adjacent roofing panels. For example, a series of gripping features can be formed or applied along the overlapping peripheral or side edge portions 308 of the covering layers. Such gripping features can be adapted or configured to engage the exposed strips 311 of the core of an adjacent roofing panel, and can further facilitate creation of a tight, interlocked engagement between adjacent roofing panels, with or without the use of additional adhesive materials or other attachment mechanisms also being applied between the overlapping peripheral or side edge portions of the covering layers and the exposed areas of the cores of adjacent roofing panels.

The foregoing description generally illustrates and describes various embodiments of the present disclosure. It will, however, be understood by those skilled in the art that various changes and modifications can be made to the above-discussed construction of the present disclosure without departing from the spirit and scope of the disclosure as disclosed herein, and that it is intended that all matter contained in the above description or shown in the accompanying drawings shall be interpreted as being illustrative, and not to be taken in a limiting sense. Moreover, while a variety of specific example roofing systems and fastening assemblies that embody principles and aspects thereof have been described in the present disclosure, it will be understood by the skilled artisan that a wide range of additions, deletions, and modifications, both subtle and gross, may well be made to the illustrated examples without departing from the spirit and scope of the present disclosure.

What is claimed is:

1. A roofing panel comprising:

a core having peripheral edges;

a plurality of layers of material;

wherein the plurality of layers of material comprises at least six layers of material, including:

a first layer of material overlying the core, the first layer of material having peripheral edges substantially aligned with the peripheral edges of the core;

a second layer of material overlying the first layer of material, the second layer of material having peripheral edges substantially aligned with the peripheral edges of the core and comprising a moisture-resistant membrane material; and a third layer of material overlying the second layer of material, the third layer of material having peripheral edges;

wherein the third layer of material is diagonally offset with respect to the core such that at least two of the peripheral edges of the third layer of material form flanges that each project beyond a corresponding peripheral edge of the core, and at least two of the peripheral edges of the third layer of material are each inwardly displaced from another corresponding peripheral edge of the core to define exposed strips of the second layer of material;

wherein the roofing panel is configured such that each of the flanges of the third layer of material overlaps an exposed strip of the second layer of material of an adjacent roofing panel when the roofing panel and the adjacent roofing panel are installed on a roof to interlock the roofing panel and the adjacent roofing panel together;

wherein the plurality of layers of material do not include an adhesive layer.

2. The roofing panel of claim 1, wherein the plurality of layers of material further comprises a fourth layer of material underlying and adhered to an inner surface of the core, the fourth layer of material having peripheral edges substantially aligned with the peripheral edges of the core; a fifth layer of material underlying and adhered to the fourth layer of material, the fifth layer of material having peripheral edges substantially aligned with the peripheral edges of the core; and a sixth layer of material underlying and adhered to the fifth layer of material, the sixth layer of material having peripheral edges, and wherein the sixth layer of material is offset relative to the core so that at least one peripheral edge of the sixth layer of material projects beyond a corresponding peripheral edge of the core.

3. The roofing panel of claim 2 wherein at least one peripheral edge of the sixth layer of material is inwardly displaced from a corresponding peripheral edge of the core to expose a strip of the fifth layer of material.

4. The roofing panel of claim 2 wherein the fifth layer of material comprises double sided self-gripping metal.

5. The roofing panel of claim 2 wherein the sixth layer of material comprises plywood or veneer and is exposed to an inside of a building when the roofing panel is installed on a roof.

6. The roofing panel of claim 2 wherein the first layer of material and the fourth layer of material comprise plywood or veneer.

7. The roofing panel of claim 1 wherein the core comprises foam.

8. The roofing panel of claim 1, wherein the core comprises polyisocyanurate (ISO), polystyrene, PVC, polyethylene, polyamide, phenolic materials, or combinations thereof.

9. The roofing panel of claim 1, wherein the flanges of the third layer of material and the exposed strips of the second layer of material of the adjacent roofing panel overlapped thereby are attached by an adhesive, by bonding, by welding, or combinations thereof.

10. The roofing panel of claim 1, wherein the core comprises interlocking features including tongues projecting from two adjacent sides of the core and cooperating recessed channels defined along opposite adjacent sides of the core.

11. A roofing panel comprising:

a core;

a plurality of layers of material;

wherein the plurality of layers of material comprises at least six layers of material, including:

a first layer of material overlying the core and adhered thereto; and a second layer of material underlying the core and adhered thereto;

wherein the core and at least some of the plurality of layers of material have a substantially rectangular configuration having a plurality of peripheral edges;

wherein the first layer of material is diagonally offset with respect to the core so that at least two peripheral edges of the first layer of material form flanges that each project beyond a corresponding peripheral edge of the core, and at least two peripheral edges of the first layer of material are each inwardly displaced from another corresponding peripheral edge of the core to expose strips of at least one layer of material below the first layer of material or a portion of the core;

wherein each of the flanges of the first layer of material is configured to overlap an exposed strip of an adjacent roofing panel when the roofing panel and the adjacent roofing panel are installed adjacent to one another on a roof to interlock the roofing panel and the adjacent roofing panel together;

wherein the plurality of layers of material do not include an adhesive layer.

12. The roofing panel of claim 11, wherein at least one of the plurality of layers of material comprises a layer of wood, and at least one of the plurality of layers of material comprises a layer of self-gripping metal configured to mechanically bond to the layer of wood.

13. The roofing panel of claim 12, wherein the layer of self-gripping metal is offset relative to the core to form interlocking features.

14. The roofing panel of claim 11 wherein the core is configured with interlocking features.

15. The roofing panel of claim 14 wherein the interlocking features comprise tongues projecting from two adjacent sides of the core and cooperating recessed channels defined along opposite adjacent sides of the core.

16. The roofing panel of claim 11, wherein the first layer of material and the second layer of material each comprise wood, and the plurality of layers of material further comprise an outer layer of self-gripping metal mechanically bonded to the first layer of material, and an inner layer of self-gripping metal, mechanically bonded to the second layer of material.

17. The roofing panel of claim 11, wherein the core comprises a thickness selected based upon a strength determined for a desired application of the roofing panel.

18. The roofing panel of claim 11, wherein each of the first layer of material and the second layer of material is coupled to the core with at least one of an adhesive, fastener, or combinations thereof.

19. The roofing panel of claim 11, wherein at least one layer of material of the plurality of layers of material further comprises a layer of plywood or veneer overlying the second layer of material and configured to be exposed to an inside of a building when the roofing panel is installed on a roof.

20. The roofing panel of claim 11, wherein core comprises a plurality of peripheral edges, and wherein at least one layer of material of the plurality of layers of material comprises a membrane layer positioned between the core and the first layer of material and having peripheral edges substantially aligned with the peripheral edges of the core.

* * * * *